US005542182A

United States Patent [19]

Martinez

[11] Patent Number: 5,542,182

[45] Date of Patent: Aug. 6, 1996

[54] COVE MITERING TOOL

[76] Inventor: Leo Martinez, 21722 Pioneer Blvd., Hawaiian Gardens, Calif. 90716

[21] Appl. No.: 444,199

[22] Filed: May 18, 1995

[51] Int. Cl.[6] ..... B26B 17/00

[52] U.S. Cl. ..... 30/179; 30/178

[58] Field of Search ..... 30/175, 179, 178, 30/124, 131, 145, 233; 83/471.3, 473, 641

[56] References Cited

U.S. PATENT DOCUMENTS

| | | | |
|---|---|---|---|
| 181,290 | 8/1876 | Simons | 30/178 |
| 1,472,392 | 10/1923 | Harvey | 30/179 |
| 2,493,513 | 1/1950 | Wagner | 30/178 |
| 2,582,736 | 1/1952 | Altieri | 30/178 |
| 3,483,901 | 12/1969 | Ray | 83/471.3 |
| 3,936,935 | 2/1976 | Gregory | 30/179 |
| 4,106,195 | 8/1978 | Berg | 30/233 X |

FOREIGN PATENT DOCUMENTS

| | | | |
|---|---|---|---|
| 2540478 | 3/1977 | Germany | 30/178 |

*Primary Examiner*—Hwei-Siu Payer
*Attorney, Agent, or Firm*—Charles H. Thomas

[57] ABSTRACT

A tool is provided for cutting linoleum cove strips. The tool includes a pair of cooperating first and second levers joined between their extremities at a fulcrum. Handles are provided on the levers on one side of the fulcrum while a flat anvil oriented parallel to the axis of lever rotation is carried by one of the levers on the opposite side of the fulcrum. The other lever carries a cutting blade oriented perpendicular to the flat anvil on the opposite of the fulcrum. A jig is mounted atop the anvil and defines a concave cove seat thereon that extends parallel to the flat anvil. The jig is coupled to the anvil by a jig mounting post that carries the jig atop the anvil for rotation about a jig axis that is perpendicular to the jig anvil. A plurality of linear blade receiving slots are defined within the jig and extend across the cove seat at different angles relative thereto. These slots lie in separate planes all intersecting each other at the jig axis. A linoleum installer can thereby achieve quick, precise, mitered cuts of cove strips utilizing the tool of the invention.

20 Claims, 5 Drawing Sheets

COVE MITERING TOOL

BACKGROUND OF THE INVENTION

1. Field of the Invention

The present invention relates to a tool useful for cutting cove strips that are used along the edges of a floor atop which linoleum or other sheet flooring is to be laid.

2. Description of the Prior Art

In the installation of linoleum flooring and other stiff, sheet flooring material it is frequently desirable for the linoleum to extend up the vertical surfaces of walls and cabinetry a short distance at transitions between the horizontal flooring and such vertical surfaces. Typically, the linoleum extends upwardly a distance of between three and six inches and is capped at its top with a trim strip.

The reason for extending the linoleum flooring a short distance up the vertical wall and cabinet surfaces is to provide a relatively smooth, concave transition between the horizontal flooring and the adjacent vertical surfaces at which the flooring terminates. This is done so as to facilitate cleaning of the edges of the flooring. Without such a smooth transition between the horizontal linoleum flooring and the surrounding vertical surfaces there is a pronounced tendency for dirt, food particles, cobwebs, and other undesirable debris to accumulate along the edges of the floor at the transition between the flooring and adjacent vertical surfaces. In the trade the provision of such a vertical extension of sheet flooring at the perimeter of the floor is referred to as "coving" the flooring.

Since in virtually all construction horizontal flooring meets the surrounding vertical surfaces of walls, baseboards, cabinetry and other upright surfaces at an angle close to ninety degrees, there is always a gap beneath the linoleum flooring where it arcuately curves from the floor to rise up the adjacent vertical surface. To prevent the linoleum from being punctured by forces exerted on it in the coved area, it is important for the linoleum to be supported from beneath continuously throughout the perimeter area where it coved up and loses contact with the floor. This support is normally provided by a cove strip.

Conventional cove strips are formed from cove sticks that are typically extruded lengths of plastic having an arcuately curved, concave outer surface. Cove sticks are commercially formed with a width of one and a half inches and also with widths of one and one-quarter inches. When the cove strips are installed their curved surfaces face upwardly and inwardly toward the room at the transitions between the floor and adjacent vertical surfaces. The curved cove strip surface provides direct, backing support for the coved linoleum as it curves upwardly toward the adjacent vertical surfaces at the perimeter of the floor.

The underside surfaces of cove strips are flat, planar surfaces that conform, respectively, to the flat surface of the floor and the vertical surfaces of the walls or cabinets at the perimeter of the floor. That is, the flat, planar surfaces on the undersides of the marginal edges of the cove strips are oriented at right angles relative to each other. These flat, mutually perpendicular surfaces normally do not extend all the way into the extreme corner of the transition between the floor and its surrounding vertical surfaces. Rather, the mutually perpendicular surfaces on the backside of the cove strips are truncated by an intermediate flat, planar backing surface that is oriented at forty-five degrees relative to both of the marginal, edge backside surfaces. This truncation saves material cost in production and also accommodates any irregularity that may exist at the intersection of the floor with the vertical surfaces that surround it.

Cove strip material is brought to the job site in long lengths often referred to as cove sticks. In installing the cove strips the cove sticks must first be cut to length. In performing these cuts the cove sticks must often be cut an angle so that the different lengths of cove strips which are cut meet properly at interior corners, exterior corners, and also at door frames and other abutting surfaces. For two lengths of cove stripping to meet properly at a corner, each of the abutting cove strip lengths must be cut at an angle of forty-five degrees, as viewed in plan view. The cove strips will thereby provide proper support to the upwardly curving linoleum disposed thereatop. Also, at door frames the cove strips must be cut at right angles so as to properly abut against the door frame moldings.

In conventional practice all cuts of cove sticks are normally performed using a conventional carpenter's miter box and a hand saw. The cove stick is positioned in the miter box and aligned with the appropriate slots in the walls thereof for the angle of cut desired. The hand saw is then worked through a number of strokes within the desired slots in the miter box walls to cut the cove stick to the desired angle.

In the installation of cove strips, a great many cuts are required. Consequently, considerable time in the aggregate is expended in sawing through the cove sticks using a carpenter's miter box. Furthermore, in order to use a miter box it is normally necessary for the box to be placed on the floor so that support is provided in making the cut. This requires the installer to spend virtually the entire time making the cuts hunched over on hands and knees. This adds to the discomfort and fatigue of the installation job. Furthermore, in performing the cuts using a miter box and saw granular debris is generated comparable to sawdust that is created in sawing wood. This debris must be cleaned up as it can otherwise interfere with the bond that the linoleum floor adhesive makes with both the floor surface upon which the linoleum is laid and the underside of the linoleum itself.

SUMMARY OF THE INVENTION

One primary object of the present invention is to provide a tool useful for cutting cove strips that are used in laying linoleum flooring. The tool of the invention allows such cuts to be made far more quickly than has heretofore been possible. Instead of requiring several strokes of a saw, the tool of the invention performs a cut with a single, swift stroke of a blade operated at an mechanical advantage.

A further object of the invention is to provide a cove strip cutting tool which reduces the fatigue experienced by an installer in cutting cove strips. Unlike a conventional carpenter's miter box, the tool of the invention provides its own support beneath the cutting blade. Thus, the linoleum installer does not need to place the tool of the invention on the floor in order to achieve the necessary backing support. Rather, the tool is a handheld device that provides its own backing and can be operated above the floor and without any other external support.

A further object of the invention is to provide a tool for cutting cove strips which does not generate granular particles that must be cleaned up. Quite to the contrary, the tool of the invention cuts the cove strip in a single slicing stroke without generating any granular debris whatsoever.

In one broad aspect the present invention may be considered to be a tool for cutting linoleum cove strips comprising a pair of cooperating first and seconds levers which are joined between their extremities at a fulcrum defining an axis of lever rotation. The levers define opposing handles on one side of the fulcrum. A flat anvil oriented parallel to the axis of lever rotation is carried by the first lever on the opposite side of the fulcrum. A cutting blade oriented perpendicular to the flat anvil is carried by the second lever on the opposite side of the fulcrum. A jig is mounted atop the anvil and defines a concave cove seat thereon that extends parallel to the flat anvil. A jig mounting post carries the jig atop the anvil for rotation above a jig axis that is perpendicular to the anvil. A plurality of linear blade receiving slots are defined in the jig and extend across the cove seat. The slots lie in separate planes all intersecting each other at the cove axis.

Preferably the jig has a base with a flat undersurface disposed in face-to-face relationship with the anvil and first and second retaining walls rising from the base and forming the cove seat atop the base and between the retaining walls. Preferably also one of the retaining walls has a lip thereon projecting toward the other of the retaining walls. The lip defines a crevice therebeneath configured to engage a longitudinal edge of a strip of linoleum coving. The provision of such a lip thereby aids in laterally stabilizing a cove strip residing on the cove seat while the cut is performed.

In a preferred embodiment of the invention there are three of the blade receiving slots angularly spaced apart forty-five degrees one from the next such that one of the blade receiving slots lies between the other two and is oriented ninety degrees relative to the cove seat. The other two slots are each oriented at forty-five degrees relative to the cove seat and are oriented at ninety degrees relative to each other.

The tool is also preferably provided with a jig rotation limit stop on the anvil that limits rotation of the jig between extreme positions of rotation in which each of the mutually perpendicular blade receiving slots resides in coplanar alignment with the cutting blade. In this way the jig can be rotated so that any one of the slots in alternation may be oriented into a coplanar relationship with the blade so that the blade passes through the selected slot in the cove seat, thereby severing the cove stick at the desired angle relative to the alignment of the cove seat.

Preferably some detent means is provided to act between the anvil and the jig to restrain rotation of the jig at each position in which any one of the blade receiving slots resides in coplanar alignment with the cutting blade. This aids the installer in achieving a cut at the desired angle, since the detent provided stabilizes the jig relative to the anvil at each of the detent positions. Indicia may be provided on both the anvil and the jig. These indicia reside in alignment with each other when any of the blade receiving slots is brought into coplanar alignment with the cutting blade.

Preferably also some means is provided to limit the extent of blade rotation toward the anvil. This prevents the blade from striking the jig with a significant force that would dull the blade or even break it as the cut is performed. Such a limit means is interposed between the levers to limit rotation of the cutting blade toward the jig and is preferably adjustable to vary the extent to which the cutting blade can enter the jig at the slots therein.

The shade of the cross section of the cove seat is configured to conform to the shape of a linoleum cove strip such that a linoleum cove strip disposed in the cove seat resides in contact therewith throughout the width of the cove seat. The cove seat is comprised of three planar surfaces oriented forty-five degrees apart one to the next. These surfaces are thereby oriented at the same angle relative to each other and are of the same width as the surfaces on the backside of commercially available cove stripping.

In another broad aspect the invention may be considered to be a tool for cutting linoleum coving strips and comprising crossed levers both having first ends equipped with handles and opposites ends. The levers are joined together between their first and opposite ends for rotation in a cutting plane about a linear fulcrum axis that is perpendicular to the cutting plane. An anvil is carried on the opposite end of one of the levers and defines a flat deck that is perpendicular to the cutting plane. A cutting blade lies in the cutting plane and is carried on the opposite end of the other lever. A jig is located atop the deck and defines a cove stick cradle extending parallel to the deck. A plurality of slots are defined in the cradle, all lying in separate planes that all intersect at a common line of intersection. This line of intersection resides in the cutting plane and is perpendicular to the deck. A jig mounting post couples the jig to the anvil for rotation relative thereto about the line of intersection. In this way the jig is rotatable atop the deck to alternatively bring each of the slots into the cutting plane.

In still another aspect the invention may be considered to be a linoleum cove strip cutting tool comprising first and second levers both having handle ends and opposite ends. The levers are crossed with each other between their extremities. A lever fulcrum connector joins the levers to each other where they cross and defines a lever fulcrum axis. Handles are provided on the handle ends of both of the levers. A cutting blade is located on the opposite end of the second lever and is movable in a path lying in a cutting plane. The cutting plane is perpendicular to the fulcrum axis. An anvil is located on the opposite end of the first lever and defines a flat upper surface lying in a plane perpendicular to the cutting plane.

A jig is disposed atop the upper surface of the anvil and defines a cove strip cradle extending parallel to the flat upper surface of the anvil. The jig defines a plurality of slots thereacross that are oriented perpendicular to the flat upper surface of the anvil and which extend into the cove strip cradle and which lie in separate planes. All of the slots intersect each other at a common jig axis that is perpendicular to the flat upper surface of the anvil. The jig axis also resides within the cutting plane. A jig mounting post joins the jig to the anvil for rotation about the jig axis.

The invention can be described with greater clarity and particularity by reference to the accompanying drawings.

DESCRIPTION OF THE EMBODIMENT

Figure 3:
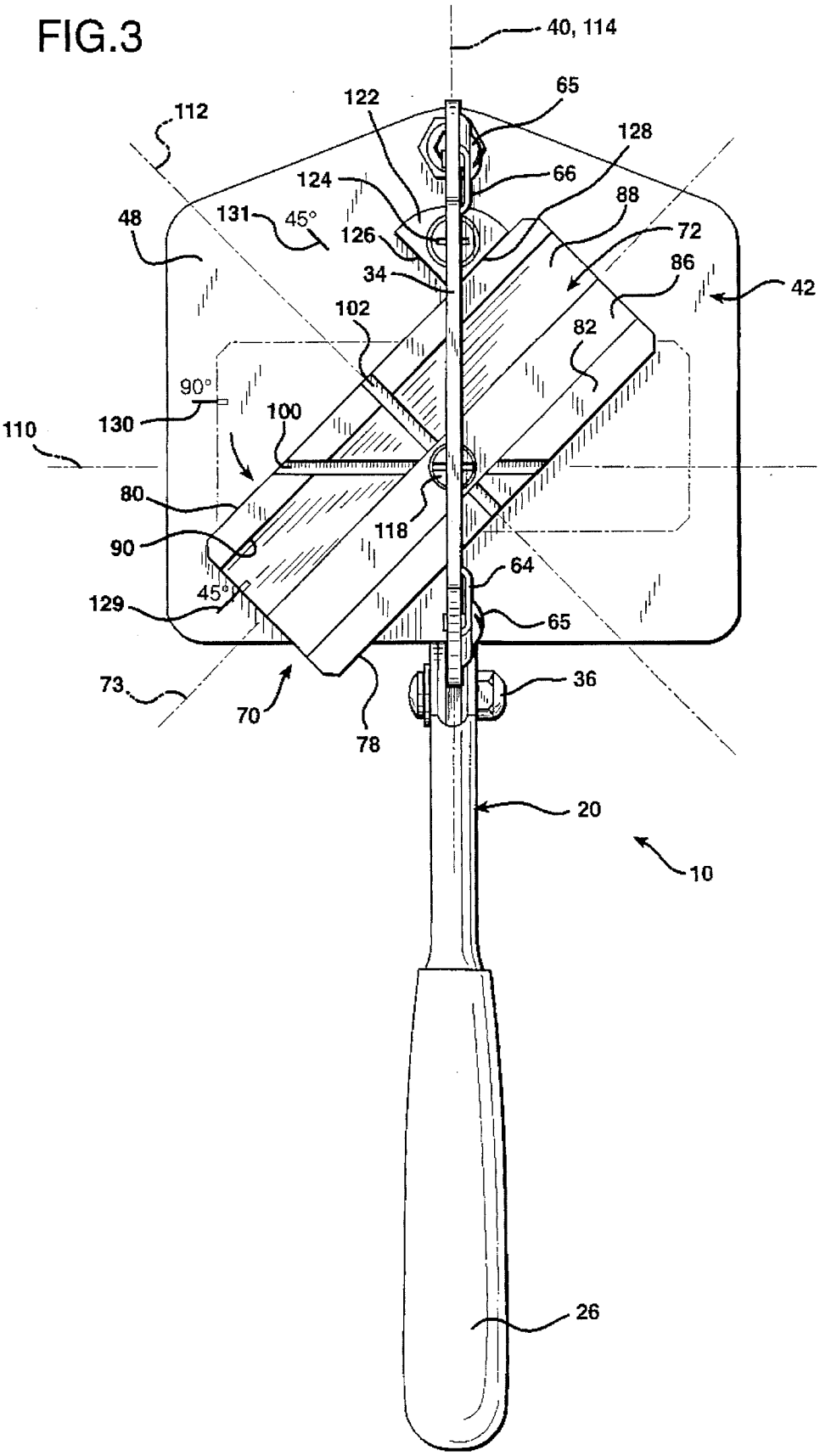
FIG. 3 is a top plan view of the tool of FIG. 1 with the jig thereof shown in one extreme position of rotation relative to the anvil thereof.
Figure 4:
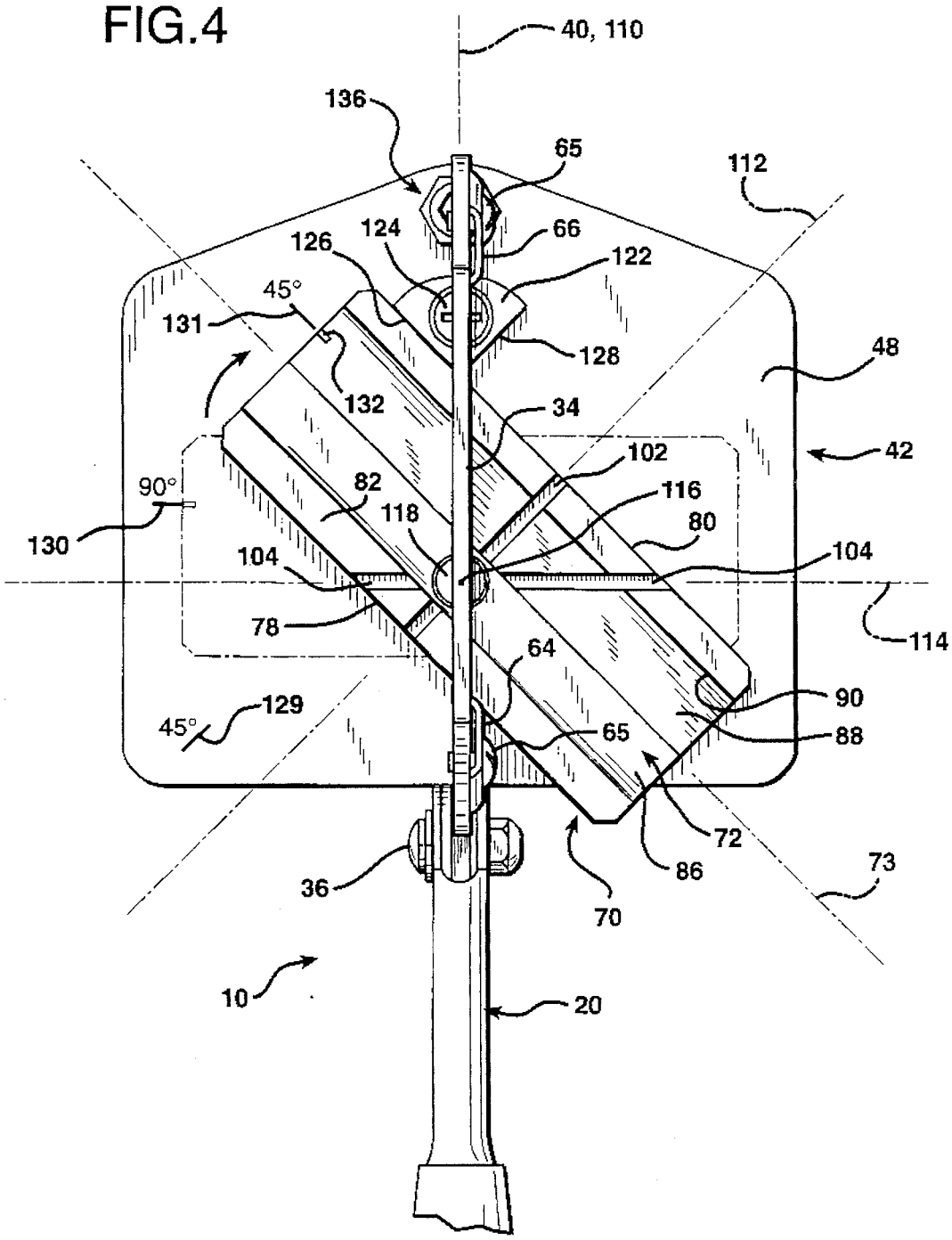
FIG. 4 is a partial top plan view of the tool as shown in FIG. 3 but with the jig rotated to an opposite extreme position of rotation.
Figure 5:
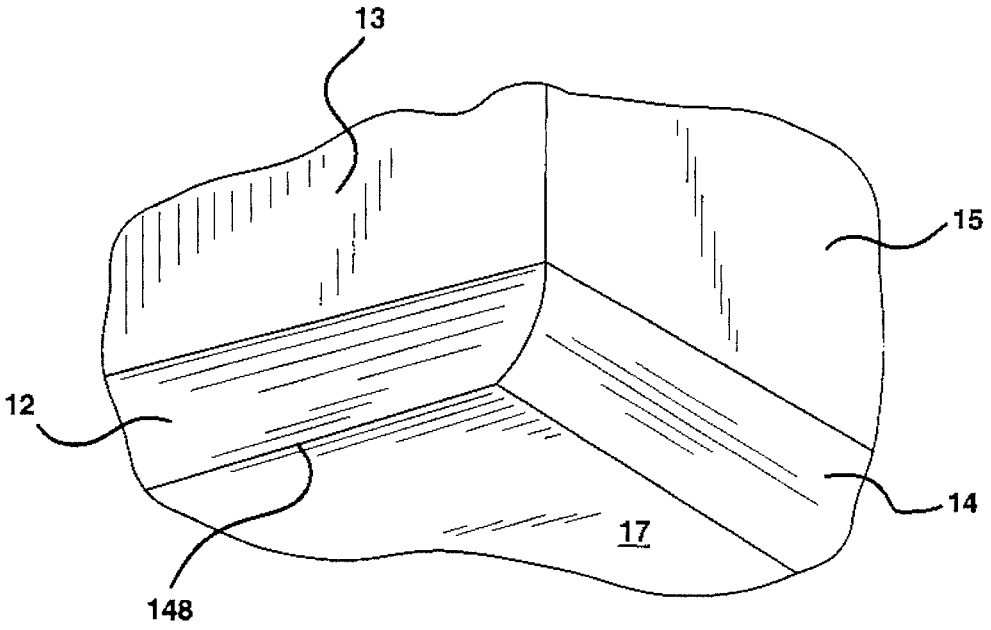
FIG. 5 is perspective view showing cove strips cut to form an interior corner with the tool of the invention.
Figure 6:
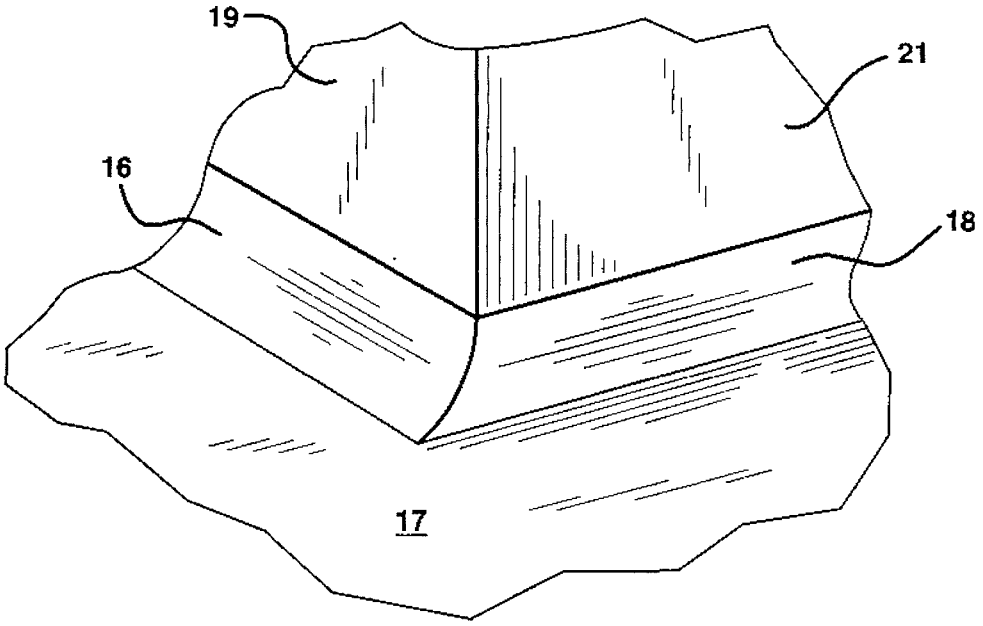
FIG. 6 is a perspective view showing cove strips cut to form an exterior corner using the tool of the invention.

FIGS. 1 through 4 illustrate a handheld tool 10 especially constructed to cut linoleum cove strips illustrated at 12, 14, 16, and 18 in FIGS. 5 and 6. The tool 10 is formed of a pair of levers. The first lever 20 has a first end 24 with a plastic handle grip 26 snugly fixed thereon and an opposite, second end 28. Similarly, the second lever 22 has a first, handle end 30 with a plastic handle grip 32 fitted thereon and an opposite, second end 34. The levers 20 and 22 cross each other between their extremities where they are joined by a fulcrum nut and bolt connection assembly 36. The two levers 20 and 22 rotate on the shank of the connector 36 about a fulcrum axis of rotation indicated at 38. The levers 20 and 22 therefore rotate substantially in a cutting plane indicated at 40 in FIGS. 3 and 4. The cutting plane 40 is perpendicular to the fulcrum axis 38.

The fulcrum area and the second end 28 of the first lever 20 are formed by a pair of elongated parallel plates that extend on both sides of the body of the second lever 22. The shank of the fulcrum connector 36 passes through these plates and through the body of the second lever 22 disposed therebetween.

A steel anvil 42 is provided and is shaped generally in the form of a pentagon. The anvil 42 has a flat, planar, upper deck surface 48 and is attached to the second end 28 of the first lever 20 by means of a pair of bolts 44 and 46. The deck 48 is preferably about four and a quarter inches in width and about four and a half inches long. The deck 48 of the flat anvil is oriented parallel to the fulcrum axis of lever rotation 38. On the underside of the deck 48 the anvil 42 has a downwardly projecting central rib 50 welded thereto. The rib 50 is captured between the two steel plates that form the second end 28 of the first lever 20. The plates pass on the opposite sides of the rib 50 and embrace it therebetween. The shanks of the bolts 44 and 46 pass through the metal plates forming the end 28 of the first lever 20 and also through the structure of the rib 50 therebetween, thereby firmly securing the rib 50 to the second end 28 of the first lever 20.

Figure 1:
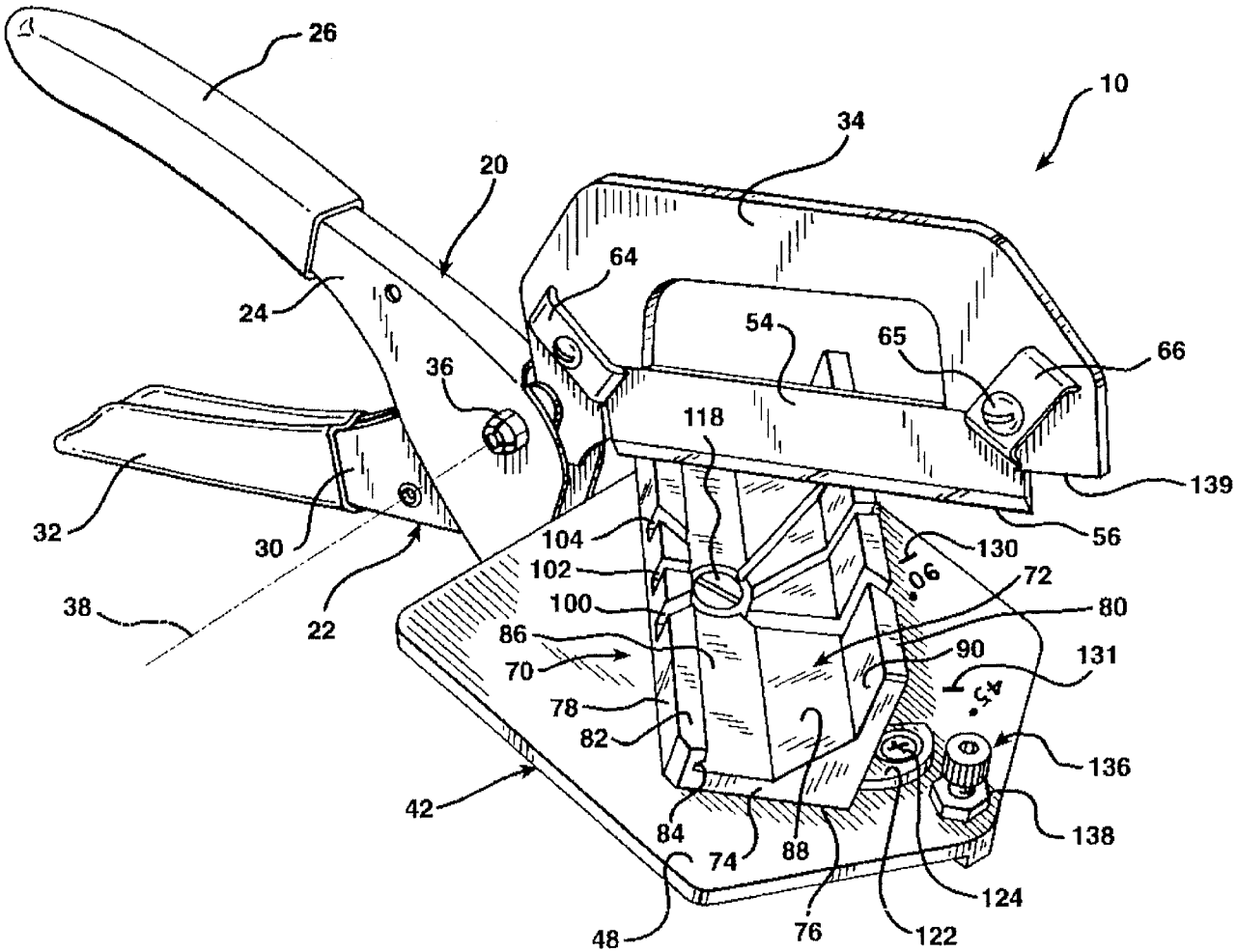
FIG. 1 is a perspective view of a preferred embodiment of a tool according to the invention.
Figure 2:
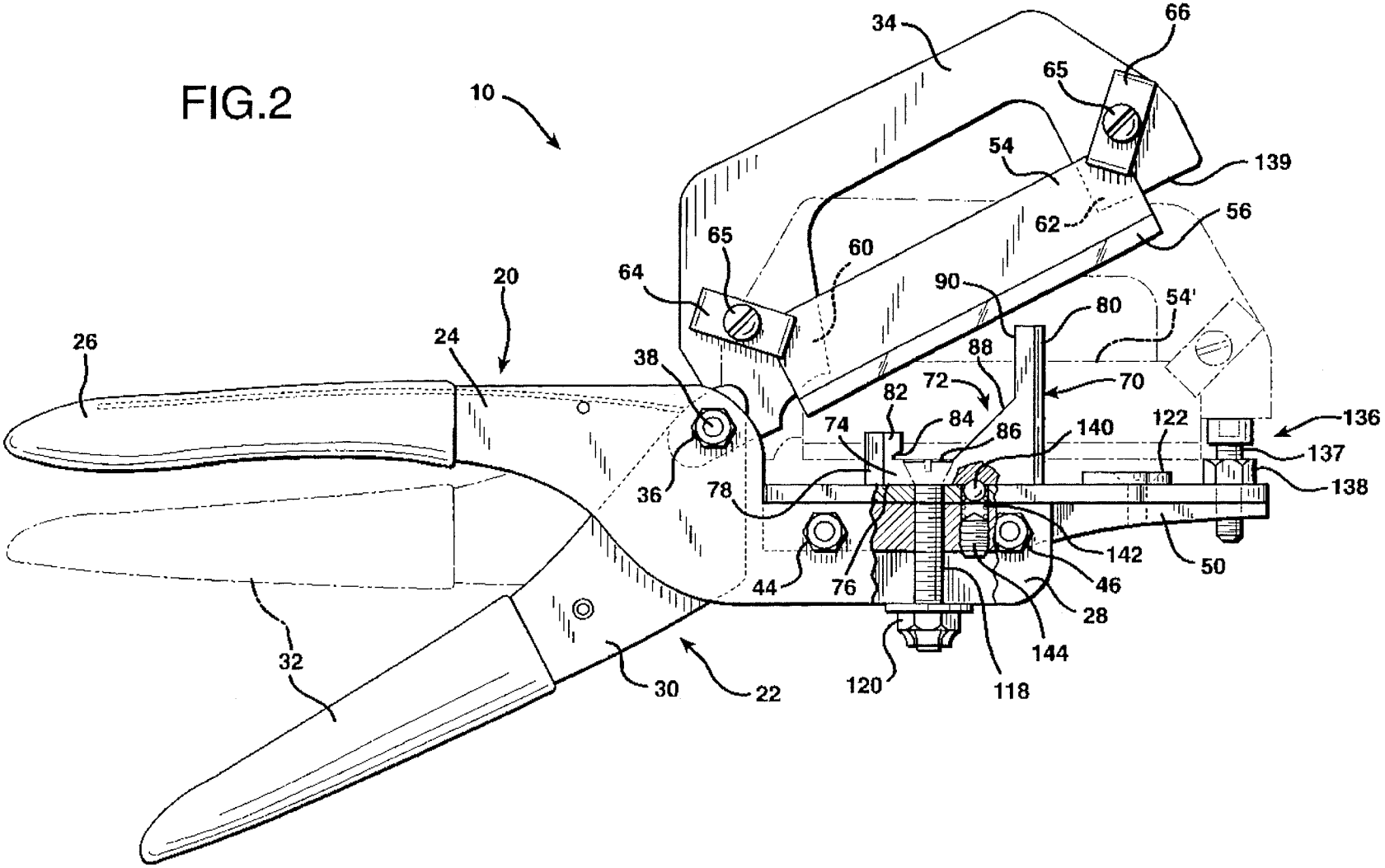
FIG. 2 is a side elevational view, partly broken away, showing the tool of FIG. 1.

The second end 34 of the second lever 22 is formed of a single, flat, generally U-shaped steel plate that is rigidly secured to the handle end 30 of the second lever 22. A thin, flat, steel blade 54, sharpened along its lower edge 56 is secured to the U-shaped plate forming the second end 34 of the second lever 22 at the inwardly facing corners thereof. That is, each of these corners behind the blade 54, as viewed in FIG. 2, is of reduced thickness, thereby forming blade corner pockets 60 and 62 configured to receive the upper corners of the blade 54. The remaining structure of the interior corners of the second end 34 behind blade 54, as viewed in FIG. 2, forms a backing surface against which the blade 54 is clamped by clamps 64 and 66.

Each clamp 64 and 66 is formed of a steel metal tab one end of which projects out over the upper corners of the blade 54 and in the central portions of which apertures are formed therethrough. Machine screws 65 extend through the apertures in the tabs of the clamps 64 and 66 and are threadably engaged in internally tapped bores through the steel plate forming the structure of the second end 34 of the second lever 22. The machine screws 65 hold the metal clamps 64 and 66 tightly against the corners of the blade 54, thereby pressing those blade corners firmly against the plate structure forming the blade pockets 60 and 62. The blade 54 is thereby rigidly carried by the second 34 of the second lever 22 and resides in the cutting plane 40 which coincides with the plane of rotation of the levers 20 and 22.

A spring (not visible) acts between the levers 20 and 22 to normally force the handle ends 24 and 30 of the levers 20 and 22 away from each other and the opposite ends 28 and 34 away from each other. The blade 54 is thereby held up and away from the jig 70 as indicted in solid lines in FIG. 2 unless the handle ends 24 and 30 of the levers 20 and 22 are squeezed together. When the handle ends 24 and 30 are squeezed together, the blade 54 is brought downward as indicated in phantom at 54' in FIG. 2.

A jig 70 is mounted atop the anvil 42 and defines a concave cove seat 72 thereon. The cove seat 72 extends parallel to the flat upper deck 48 of the anvil 42 and is aligned along a longitudinal axis indicated at 73. The jig 70 is constructed of a base portion 74 having a flat undersurface 76 that is disposed in face-to-face relationship with the deck 48 of the anvil 42. The jig 70 is also formed with a relatively low front retaining wall 78 and a higher, rear retaining wall 80. The walls 78 and 80 rise from the base 74 to form the cove seat 72. The front retaining wall 78 has a lip 82 thereon that projects toward the higher wall 80 and defines a crevice 84 beneath the lip 82. The crevice 84 is configured to engage a longitudinal edge of a strip of linoleum coving 12–18.

As illustrated in FIG. 2, the cove seat is comprised of three planar surfaces 86, 88, and 90 which are oriented forty-five degrees apart one to the next. The surfaces 86 and 90 are oriented perpendicular to each other, with the surface 86 residing in a plane parallel to the deck surface 48 of the anvil 42, while the surface 90 resides in a plane perpendicular thereto. The intermediate surface 88 is oriented at a forty-five degree angle relative to both the surfaces 86 and 90, as well as to the deck surface 48 of the anvil 42. The surfaces 86, 88, and 90 are configured to conform to the shape of the undersides of coving sticks that are used to form the coving strips 12–18.

The jig 70 also is formed with a plurality of linear, blade receiving slots denoted at 100, 102, and 104 in FIGS. 4 and 5. As illustrated in those drawing figures the slots 100, 102, and 104 extend across the cove seat 72, partially down through both the retaining walls 78 and 80 and the base 76 thereof. The slots 100, 102, and 104 all lie in separate planes indicated, respectively, at 110, 112, and 114 in FIGS. 3 and 4. As illustrated in those drawing figures the blade receiving slots 100, 102, and 104 are angularly spaced apart forty-five degrees, one from the next such that the blade receiving slot 102 lies between the other two slots 100 and 104 and is oriented at ninety degrees relative to the longitudinal alignment axis 73 of the cove seat 72. The slots 100 and 104 on the other hand, are each oriented at forty-five degrees relative to the cove seat 72, in opposite directions relative to the perpendicular alignment of the slot 102 and at ninety degrees relative to each other.

It should be noted that the slots 100, 102, and 104 all lie in separate planes 110, 112, and 114, respectively, that all intersect at a common line of intersection 116. The line of intersection 116 resides in the cutting plane 40 and is perpendicular to the deck 48. As best illustrated in FIG. 2, a jig mounting post formed by the shank of a bolt 118 couples the jig 70 to the anvil 42 for rotation relative thereto about the line of intersection 116. As is evident from FIGS. 3 and 4, the jig 70 is thereby rotatable atop the deck 42 to alternatively bring each of the slots 100, 102, and 104, into the cutting plane 40.

The head of the mounting post bolt 118 resides in a countersunken recess defined in the flat, upper horizontal surface 86 of the jig base 74. The shank of the bolt 118 extends down through the anvil deck 48 and through the rib 50 and emerges between the two plates forming the opposite sides of the second end 28 of the first lever 20. The shank of the bolt 118 is secured to the second end 28 of the first level 20 by means of a nut 120.

As illustrated in FIGS. 3 and 4, the jig 70 can be rotated atop the deck 48 about the axis 116 in the manner of a turntable. The extent of rotation of the jig 70 is limited, however, by the provision of a sector-shaped jig rotation limit stop 122 on the deck 48 of the anvil 42. The limit stop 122 is secured to the anvil 42 by means of a machine screw 124, the head of which is seated in a countersunken recess in the limit stop 122. The limit stop 122 is formed as a quadrant of a circle and has surfaces 126 and 128 perpendicular to the deck 48 and inclined relative to the cutting plane 40 at an angle of forty-five degrees on the opposite sides of the cutting plane 40. As is evident in FIGS. 3 and 4, the limit stop 122 prevents rotation of the jig 70 beyond the extreme positions of rotation depicted in FIGS. 3 and 4 in which each of the blade receiving slots 100 and 104 alternatively resides in coplanar alignment with the cutting blade 54.

Also, the anvil 42 is provided with three indicia 129, 130, and 131. These indicia are scribe lines formed in the deck 48 and are numbered by the angle of alignment of the cove seat 72 when the jig 70 is rotated so that another scribe line indicia 132 thereon resides in alignment with a corresponding indicia on the deck 48. That is, when the indicia 129 on the deck 48 is aligned with the indicia 132 on the jig 70, as shown in FIG. 3, the cove seat 72 resides at an angle of forty-five degrees in one direction relative to the cutting plane 40. When the jig 70 is rotated clockwise forty-five degrees from the position of FIG. 3 so that the indicia 132 thereon is aligned with the indicia 130 on the deck 48, the cove seat 72 is aligned at an angle of ninety degrees relative to the cutting plane 40. When the jig 70 is rotated forty-five degrees further in a clockwise direction to the position shown in FIG. 4, the indicia 131 on the deck 48 and the indicia 132 on the jig 70 are aligned and the numerical indicia on the deck 48 indicates that the cove seat 72 resides at an angle of forty-five degrees relative to the cutting plane 40. The user is thus provided with a means for checking the accuracy of miter cuts in coving sticks.

As shown in FIG. 2, the tool 10 is also provided with a detent system. This detent mechanism includes three concave depressions in the flat underside 76 of the jig base 74 oriented forty-five degrees apart relative to the jig axis 116. Each of these depressions is located at the same radial distance from the jig axis 116. The depressions are located directly under each of the slots 100, 102, and 104.

The anvil 42 is formed with an opening at the same radial distance from the jig axis 116 as the depressions in the undersurface 76 of the jig base 74. An opening is formed through the deck 48 and also through the structure of the rib 50. Within the opening in the deck 48 a detent sphere 140 is positioned atop a coil spring 142. The opposite end of the coil spring 142 bears against the adjacent end of a plug 144 that is externally threaded and advanced into the bore through the rib 50. The plug 144 can be advanced into the bore and counter-rotated relative thereto from beneath the anvil 42 to the extent desired by means of a blade screwdriver. This allows compression of the spring 142 to a desired extent to achieve an appropriate upward detent force on the detent sphere 140.

As the jig 70 is rotated atop deck 48, the spring 142 will be further compressed each time the jig 70 is rotated to a position other than one of the three positions illustrated in FIGS. 2, 3, and 4. At those three positions the spring can expand slightly to press the detent sphere 140 up into a corresponding depression in the underside 76 of the jig base 74. This tends to restrain rotation of the jig 70 at each position of rotation thereof relative to the deck 48 in which any one of the blade receiving slots 100, 102, or 104 resides in coplanar alignment with the cutting blade 54 in the cutting plane 40. By providing such a detent system the linoleum installer is assured of true forty-five and ninety degree cuts in the coving sticks.

The tool 10 also includes a blade rotation limiting device indicated generally at 136. The blade rotation limiting device 136 is interposed between the levers 20 and 22 to limit movement of the cutting blade 54 toward the jig 70. Specifically, the blade rotation limiting device 136 is formed of a bolt 137 that is threaded into a nut 138. The nut 138 is welded or otherwise permanently secured atop the deck 48 of the anvil 42. The anvil 42 is bored with an opening that aligns with the internally threaded opening in the nut 138 so as to permit advancement and withdrawal of the shank of the bolt 137.

When the bolt 137 is backed out of the nut 138 by counterrotation relative thereto, the height of the head of the bolt 137 above the level of the deck 48 is raised. The head of the bold 137 thereby forms an obstruction that limits downward movement of the edge 139 at the extremity of the end 34 of the second lever 22. This interfering relationship between the surface 139 and the end of the lever 22 and the head of the bolt 137 limits the extent to which the blade 34 can pass downwardly through the slots 100, 102, and 104 in the jig 70.

Conversely, advancing the bolt 137 into the nut 138 lowers the height of the head of the bolt 137 relative to the deck 48. Thus, the end 34 of the lever 22 can be rotated downwardly closer to the deck 48, thereby permitting greater penetration of the blade 54 into the slots 100, 102 and 104. The height of the head of the bolt 137 is adjusted so that the blade 54 will cut completely through the cove stick position on the cove seat 172, but not so far as to allow the sharp edge 56 of the blade 54 to strike the structure of the jig 70.

To use the tool 10 to cut the cove strip 12 for an interior corner, illustrated in FIG. 5, a linoleum installer rotates the jig 70 to the position of FIG. 3. The jig 70 thereupon abuts the surface 128 of the limit stop 122 and the detent sphere 140 tends to prevent the jig 70 from rotating about the axis 116. The installer then places the cove strip 12 in the cove seat 72 such that the coving stick extends lengthwise in alignment with the longitudinal orientation of the cove seat 72 and projects off to the lower left as viewed in FIG. 3. The edge 148 of the cove stick extends beneath the lip 82 of the jig 70 and nests in the crevice 84. The cove stick is thereby stabilized in the cove seat 72.

Once the jig 70 has been rotated to the position of FIG. 3 and the cove stick seated in the cove seat 72 with the edge 148 thereof residing in the crevice 84, the user squeezes the handle ends 24 and 30 of the tool 10 together. This brings the blade 54 in the cutting plane 40 downwardly toward the anvil 70 and into the slot 114. The cove strip 12 is thereby cut with an accurate, forty-five degree miter cut. The user releases the handle ends 24 and 30 so that the spring between the levers 20 and 22 forces the blade 54 back up away from the jig 70 once again to the position shown in solid lines in FIG. 2. The cove strip 12 can thereupon be installed at the transition between the floor 17 and wall 13 as shown in FIG. 5.

The installer may then wish to cut the cove strip 14. To achieve the complementary cut to that used to form the cove strip 12, the installer rotates the jig from the position of FIG. 3 to the position of FIG. 4. The jig 70 is rotated all the way until the backside of the retaining wall 80 contacts the limit stop 122. When the jig 70 is in this position the detent sphere 140 is pressed up into the corresponding recess in the underside of the jig 70 beneath the slot 100. The cove strip 14 is positioned on the cove seat 72 so as to project off to the lower right, as viewed in FIG. 4. The cove strip 14 resides in the cradle formed by the cove seat 72. The installer then again squeezes the handle ends 24 and 30 of the levers 20 and 22 together, thereby creating an accurate, complementary miter cut at the end of the cove strip 14. The cove strip 14 is then installed at the junction of the floor 17 with the wall 15, as illustrated in FIG. 5. The installer then moves on to cut the next cove strip.

Cove strips 16 and 18 for an exterior corner are illustrated in FIG. 6. To perform these cuts the user rotates the jig 70 to the position of FIG. 4 and seats the cove stick in the cove seat 72 such that it extends up and to the left as viewed in that drawing figure. The installer thereupon squeezes the handle ends 24 and 30 of the levers 20 and 22 together, thereby bringing the blade 54 down into the slot 100 to cleanly slice a forty-five degree miter at the end of the cove strip 16.

To cut the cove strip 18 the installer rotates the jig 70 from the position FIG. 4 to that of FIG. 3 with the cove stick extending up and to the right and seated in the cove seat 72. The handle ends 24 and 30 of the levers 20 and 22 are again squeezed together to overcome the biasing force of the spring tending to push them apart. The blade 54 is thereupon brought down into the slot 100 and through the cove seat, thereby creating a clean forty-five degree external cut at the end of the cove strip 18. The cove strips 16 and 18 can thereupon be installed against the floor 17 and walls 19 and 21 as illustrated in FIG. 6.

The jig 70 is rotated atop the anvil 42 to the position depicted in FIG. 2 to perform cuts at ninety degrees relative to the cove strip axis 73. With a cove strip seated in the cove strip seat 72 while the jig 70 is in this position, the blade 54 will travel downward in the cutting plane 40 and into the slot 102 in the jig 70. This creates a clean, right angle cut for a coving strip which is to abut a perpendicular surface, such as a door frame.

By using the cove miter tool 10 of the invention a linoleum installer is able to perform precise, clean mitered cove strip cuts with a single squeeze on the handgrips 26 and 32 of the levers 20 and 22. Cove strips, such as the strips 12–18 depicted in FIGS. 5 and 6, can be cut quickly and easily in far less time than is possible using a carpenter's miter box. Furthermore, the cuts can be performed while the installer is standing or is otherwise in a position far more comfortable than is possible while performing cove cuts using conventional techniques. Also, since the blade 54 slices cleanly through the structure of the cove stick no granular debris is generated in the process.

Other advantages and uses of the tool 10 will undoubtedly occur to those familiar with flooring installation. For example, the tool 10 can be used to cut reducer or transition strips, as well as cove sticks, in the installation of linoleum. Such reducer or transition strips are employed at an edge of linoleum abutting a doorway where there is a transition to a different material, such as concrete or tile. The tool 10 can be used to considerable advantage in performing cuts on reducer or transition strips in the same manner as cutting coving sticks, as described herein.

Accordingly, the scope of the invention should not be construed as limited to the specific embodiment depicted and described.

I claim:

1. A linoleum cove strip cutting tool comprising: first and second levers both having handle ends and opposite ends and which are crossed with each other between their extremities, a lever fulcrum connector joining said levers to each other where they cross and defining a lever fulcrum axis, handles on said handle ends of both of said levers, a cutting blade located on said opposite end of said second lever and movable in a path lying in a cutting plane that is perpendicular to said fulcrum axis, an anvil located on said opposite end of said first lever and defining a flat upper surface lying in a plane perpendicular to said cutting plane, a jig disposed atop said flat upper surface of said anvil and defining a cove strip cradle extending parallel to said flat upper surface of said anvil, said jig defining a plurality of slots thereacross that are oriented perpendicular to said flat upper surface of said anvil and which extend into said cove strip cradle and which lie in separate planes that all intersect each other at a common jig axis that is perpendicular to said flat upper surface of said anvil, said jig axis also residing within said cutting plane, and a jig mounting post joining said jig to said anvil for rotation relative thereto about said jig axis.

2. A linoleum strip cutting tool according to claim 1 wherein said jig is formed with a base and retaining walls rising from said base so as to define said cove strip cradle between said retaining walls.

3. A tool according to claim 2 wherein one of said retaining walls is provided with an elongated lip that overhangs said cove strip cradle so as to form a crevice for engaging an edge of a cove strip disposed in said cove strip cradle.

4. A tool for cutting linoleum cove strips comprising: a pair of cooperating first and second levers which are joined between their extremities at a fulcrum defining an axis of lever rotation, said levers defining opposing handles on one side of said fulcrum, a flat anvil oriented parallel to said axis of lever rotation and carried by said first lever on the opposite side of said fulcrum, a cutting blade oriented perpendicular to said flat anvil and carried by said second lever on the opposite side of said fulcrum, a jig mounted atop said anvil and defining a concave cove seat thereon that extends parallel to said flat anvil, a jig mounting post carrying said jig atop said anvil for rotation about a jig axis perpendicular to said anvil, and a plurality of linear blade receiving slots defined in said jig and extending across said cove seat, said slots lying in separate planes all intersecting each other at said jig axis.

5. A tool according to claim 4 wherein said jig has a base with a flat undersurface disposed in face-to-face relationship with said anvil, and first and second retaining walls rising from said base and forming said cove seat atop said base and between said retaining walls.

6. A tool according to claim 5 wherein one of said retaining walls has a lip thereon projecting toward the other of said retaining walls and wherein said lip defines a crevice therebeneath configured to engage a longitudinal edge of a strip of linoleum coving.

7. A tool according to claim 4 wherein there are three of said blade receiving slots angularly spaced apart forty-five degrees one from the next, such that one of said blade receiving slots lies between the other two and is oriented at ninety degrees relative to said cove seat, and said other two slots are each oriented at forty-five degrees relative to said cove seat and at ninety degrees relative to each other.

8. A tool according to claim 7 further comprising a jig rotation limit stop on said anvil that limits rotation of said jig between extreme positions of rotation in which each of said other two blade receiving slots resides in coplanar alignment with said cutting blade.

9. A tool according to claim 7 further comprising detent means acting between said anvil and said jig to restrain rotation of said jig at each position of rotation in which a blade receiving slot resides in coplanar alignment with said cutting blade.

10. A tool according to claim 7 further comprising indicia on said anvil and indicia on said jig which reside in alignment when a blade receiving slot is brought into coplanar alignment with said cutting blade.

11. A tool according to claim 4 further comprising a blade rotation limiting means interposed between said levers to limit movement of said cutting blade toward said jig.

12. A tool according to claim 11 wherein said blade rotation limiting means is adjustable to vary the extent to which said cutting blade is moveable toward said jig.

13. A tool according to claim 4 wherein the shape of the cross section of said cove seat is configured to conform to the shape of a linoleum cove strip such that a linoleum cove strip disposed in said cove seat resides in contact therewith throughout the width of said cove seat.

14. A tool according to claim 13 wherein said cove seat is comprised of three planar surfaces oriented forty-five degrees apart one to the next.

15. A tool for cutting linoleum coving strips and comprising crossed levers both having first ends equipped with handles and opposite ends and joined together between said first and opposite ends for rotation in a cutting plane about a linear fulcrum axis that is perpendicular to said cutting plane, an anvil carried on said opposite end of one of said levers and defining a flat deck that is perpendicular to said cutting plane, a cutting blade lying in said cutting plane and carried on said opposite end of the other of said levers, a jig located atop said deck and defining a cove stick cradle extending parallel to said deck, a plurality of slots defined in said cradle, said slots lying in separate planes that all intersect at a common line of intersection that resides in said cutting plane and is perpendicular to said deck, and a jig mounting post coupling said jig to said anvil for rotation relative thereto about said line of intersection, whereby said jig is rotatable atop said deck to alternatively bring each of said slots into said cutting plane.

16. A tool according to claim 15 wherein said cove stick cradle is comprised of three planar cradle surfaces oriented at forty-five degrees one to the next.

17. A tool according to claim 16 wherein said jig is further comprised of a retaining lip extending linearly along one side of said cove stick cradle and which intersects an adjacent one of said planar cradle surfaces to form a crevice therebetween for engaging an edge of a cove stick disposed in said cove stick cradle.

18. A tool according to claim 15 further comprising an adjustable blade movement limiting obstruction mounted atop said deck in said cutting plane in the path of movement of said opposite end of said second lever to limit the approach of said blade toward said deck.

19. A tool according to claim 15 wherein there are three said slots in said cradle oriented forty-five degrees apart from one to the next, the centermost of which is oriented perpendicular to the orientation of said cove stick cradle.

20. A tool according to claim 19 further comprising detent means acting between said anvil and said jig to restrain rotation of said jig upon rotation thereof relative to said anvil to a position which brings any of said slots into coplanar alignment with said cutting blade.

* * * * *